US009630307B2

(12) United States Patent
Ludy et al.

(10) Patent No.: US 9,630,307 B2
(45) Date of Patent: Apr. 25, 2017

(54) ROTARY HAMMER

(71) Applicant: Milwaukee Electric Tool Corporation, Brookfield, WI (US)

(72) Inventors: Benjamin Ludy, Jackson, WI (US); Daryl S. Richards, Sussex, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 714 days.

(21) Appl. No.: 13/971,131

(22) Filed: Aug. 20, 2013

(65) Prior Publication Data

US 2014/0054057 A1 Feb. 27, 2014

Related U.S. Application Data

(60) Provisional application No. 61/691,920, filed on Aug. 22, 2012.

(51) Int. Cl.

| | |
|---|---|
| ***B25D 11/04*** | (2006.01) |
| ***B25D 11/12*** | (2006.01) |
| ***B25D 16/00*** | (2006.01) |

(52) U.S. Cl.

CPC ..... *B25D 11/12* (2013.01); *B25D 11/04* (2013.01); *B25D 11/125* (2013.01); *B25D 16/006* (2013.01); *B25D 2216/0015* (2013.01); *B25D 2216/0023* (2013.01); *B25D 2216/0038* (2013.01); *B25D 2216/0046* (2013.01); *B25D 2216/0069* (2013.01)

(58) Field of Classification Search

CPC ..... B25D 16/00; B25D 2211/068; B25D 2216/0084

USPC ..... 173/47, 205

See application file for complete search history.

(56) References Cited

U.S. PATENT DOCUMENTS

| | | | |
|---|---|---|---|
| 3,006,202 | A | 10/1961 | Moorhead |
| 3,334,694 | A | 8/1967 | Schnettler |
| 3,430,708 | A | 3/1969 | Miller |
| 3,777,869 | A | 12/1973 | Rix et al. |
| 3,794,124 | A | 2/1974 | Biersack |
| 3,834,468 | A | 9/1974 | Hettich et al. |
| 3,835,715 | A | 9/1974 | Howell |
| 3,850,255 | A | 11/1974 | Koehler |
| 3,876,014 | A | 4/1975 | Moores, Jr. |
| 3,937,036 | A | 2/1976 | Sauerwein |
| 4,066,136 | A | 1/1978 | Wanner et al. |

(Continued)

*Primary Examiner* — Thanh Truong
*Assistant Examiner* — Patrick Fry
(74) *Attorney, Agent, or Firm* — Michael Best & Friedrich LLP

(57) ABSTRACT

A rotary hammer is adapted to impart axial impacts to a tool bit. The rotary hammer includes a motor, a spindle coupled to the motor for receiving torque from the motor, and a piston at least partially received within the spindle for reciprocation therein. A crank hub is coupled to the motor for receiving torque from the motor. The crank hub defines a rotational axis and includes a socket offset from the rotational axis. A pin includes a first portion at least partially received within the socket and a second portion fixed to the piston. The first portion of the pin is both pivotable within the socket and axially displaceable relative to the socket in response to rotation of the crank hub for reciprocating the piston between a forward-most position within the spindle and a rearward-most position within the spindle.

19 Claims, 8 Drawing Sheets

(56) References Cited

U.S. PATENT DOCUMENTS 4,114,699 A * 9/1978 Wolf ..... B25D 16/00 173/109
4,158,313 A 6/1979 Smith
4,236,588 A 12/1980 Möldan et al.
4,365,962 A 12/1982 Regelsberger
4,436,163 A * 3/1984 Simpson ..... A01G 3/053 173/109
4,442,906 A * 4/1984 Simpson ..... B25D 11/005 173/122
4,446,931 A 5/1984 Bleicher et al.
4,462,467 A * 7/1984 Weingartner ..... B25D 16/00 173/105
4,529,044 A 7/1985 Klueber et al.
4,732,217 A 3/1988 Bleicher et al.
4,732,218 A 3/1988 Neumaier et al.
4,763,733 A 8/1988 Neumaier
5,036,925 A 8/1991 Wache
5,343,961 A 9/1994 Ichikawa
5,379,848 A 1/1995 Rauser
5,447,205 A * 9/1995 Thurler ..... B25D 16/00 173/13
5,588,496 A 12/1996 Elger
5,711,380 A 1/1998 Chen
5,787,996 A 8/1998 Fünfer
5,842,527 A 12/1998 Arakawa et al.
5,992,257 A 11/1999 Nemetz et al.
6,015,017 A 1/2000 Lauterwald
6,035,945 A 3/2000 Ichijyou et al.
6,109,364 A 8/2000 Demuth et al.
6,176,321 B1 1/2001 Arakawa et al.
6,192,996 B1 2/2001 Sakaguchi et al.
6,196,330 B1 3/2001 Matthias et al.
6,223,833 B1 5/2001 Thurler et al.
6,457,535 B1 10/2002 Tanaka
6,460,627 B1 10/2002 Below et al.
6,478,095 B2 11/2002 Neumaier
6,510,903 B2 * 1/2003 Funfer ..... B25D 16/006 173/48
6,520,267 B2 * 2/2003 Funfer ..... B25D 16/006 173/170
6,550,546 B2 4/2003 Thurler et al.
6,557,648 B2 5/2003 Ichijyou et al.
6,619,149 B2 * 9/2003 Funfer ..... B25D 16/006 173/48
6,666,284 B2 12/2003 Stirm
6,691,796 B1 2/2004 Wu
6,712,156 B2 * 3/2004 Funfer ..... B25D 16/006 173/104
6,725,944 B2 4/2004 Burger et al.
6,733,414 B2 5/2004 Elger
6,793,023 B2 9/2004 Holzer et al.
6,907,943 B2 6/2005 Ikuta
6,913,090 B2 7/2005 Droste et al.
6,918,450 B2 7/2005 Lebisch et al.
6,942,435 B2 9/2005 Schaible et al.
6,971,455 B2 12/2005 Shibata et al.
6,976,545 B2 12/2005 Greitmann
6,978,847 B2 12/2005 Buchholz
6,988,563 B2 1/2006 Hashimoto et al.
7,051,820 B2 5/2006 Stirm
7,059,425 B2 6/2006 Ikuta
7,121,359 B2 10/2006 Frauhammer et al.
7,124,839 B2 10/2006 Faruta et al.
7,168,169 B2 1/2007 Moreno
7,216,749 B2 5/2007 Droste
7,296,635 B2 11/2007 Droste
7,303,026 B2 12/2007 Frauhammer et al.
7,306,048 B2 12/2007 Yamazaki
7,306,049 B2 * 12/2007 Soika ..... B25D 16/006 173/109
7,306,058 B2 12/2007 Cargill et al.
7,314,097 B2 1/2008 Jenner et al.
7,322,427 B2 1/2008 Shimma et al.
7,325,624 B2 2/2008 Yamazaki
7,331,408 B2 * 2/2008 Arich ..... B25D 16/00 173/201
7,331,496 B2 * 2/2008 Britz ..... B25D 16/006 227/29
7,350,592 B2 4/2008 Hahn et al.
7,383,893 B2 6/2008 Shimma et al.
7,395,872 B2 * 7/2008 Duesselberg ..... B25D 16/006 173/109
7,410,007 B2 8/2008 Chung et al.
7,469,752 B2 12/2008 Furusawa et al.
RE40,643 E 2/2009 Stirm
7,506,694 B2 3/2009 Stirm et al.
7,549,484 B2 6/2009 Iwakami et al.
7,568,531 B2 8/2009 Omi
7,591,324 B2 9/2009 Saur
7,647,985 B2 1/2010 Furusawa et al.
7,705,497 B2 * 4/2010 Arich ..... B25D 16/00 173/117
7,708,084 B2 5/2010 Duesselberg et al.
7,717,191 B2 5/2010 Trautner
7,717,192 B2 5/2010 Schroeder et al.
7,735,575 B2 6/2010 Trautner
7,748,472 B2 7/2010 Yoshikane
7,762,349 B2 7/2010 Trautner et al.
7,798,245 B2 9/2010 Trautner
7,806,198 B2 10/2010 Puzio
7,814,986 B2 10/2010 Berhauser et al.
7,828,073 B2 11/2010 Liebert et al.
7,828,077 B1 11/2010 Miller et al.
7,836,802 B2 11/2010 Yoon
7,854,274 B2 12/2010 Trautner et al.
7,857,074 B2 12/2010 Meixner
7,886,838 B2 2/2011 Hahn
7,891,438 B2 2/2011 Ullrich et al.
7,896,097 B2 3/2011 Teng
7,918,286 B2 4/2011 Nagasaka et al.
7,931,095 B2 4/2011 Machida et al.
7,987,920 B2 8/2011 Schroeder et al.
7,987,921 B2 8/2011 Hahn
7,987,930 B2 8/2011 Purcell
8,016,523 B2 9/2011 Vasudeva et al.
8,024,995 B2 9/2011 Dayton et al.
8,028,760 B2 10/2011 Yoshikane
8,061,000 B2 11/2011 Santamarina et al.
8,061,718 B2 11/2011 Krondorfer
8,061,784 B2 11/2011 Hall et al.
8,066,456 B2 11/2011 Mohr et al.
8,069,929 B2 12/2011 Sugimoto et al.
8,083,006 B2 12/2011 Simm et al.
8,087,474 B2 1/2012 Shinma et al.
8,104,544 B2 1/2012 Ullrich et al.
8,109,343 B2 2/2012 Schroeder et al.
8,122,971 B2 2/2012 Whitmire et al.
8,122,972 B2 * 2/2012 Soika ..... B25D 11/125 173/112
8,132,990 B2 3/2012 Bauman
8,157,021 B2 4/2012 Chen
8,162,581 B2 4/2012 Soltis et al.
8,172,235 B2 5/2012 Furusawa et al.
8,172,236 B2 5/2012 Shibata
8,176,817 B2 5/2012 Liu
8,191,648 B2 6/2012 Watanabe et al.
8,191,649 B2 6/2012 Zhu
8,220,135 B2 7/2012 Vogel et al.
8,220,804 B2 7/2012 Erickson
8,230,943 B2 7/2012 Felger
8,235,137 B2 8/2012 Walker et al.
8,286,972 B2 10/2012 Haimer
8,292,304 B2 10/2012 Wienhold
8,297,893 B2 10/2012 Hangleiter
8,308,168 B2 11/2012 Nash
8,312,944 B2 11/2012 Marshall et al.
8,366,120 B2 2/2013 Hu
8,366,121 B2 2/2013 Hu
8,366,592 B2 2/2013 Hathaway et al.
8,371,779 B2 2/2013 Steadings et al.
8,381,830 B2 2/2013 Puzio et al.
8,424,879 B2 4/2013 Reinauer
2006/0137889 A1 6/2006 Hanke

(56) References Cited

U.S. PATENT DOCUMENTS

| | | | | |
|---|---|---|---|---|
| 2006/0156859 | A1* | 7/2006 | Nemetz | B25D 16/00 74/606 R |
| 2006/0237205 | A1 | 10/2006 | Sia et al. | |
| 2007/0267207 | A1 | 11/2007 | Ito | |
| 2008/0000663 | A1 | 1/2008 | Sell | |
| 2008/0169111 | A1 | 7/2008 | Duesselberg et al. | |
| 2008/0236855 | A1 | 10/2008 | Meixner et al. | |
| 2009/0159304 | A1 | 6/2009 | Teranishi et al. | |
| 2010/0071923 | A1 | 3/2010 | Rudolph et al. | |
| 2010/0132354 | A1 | 6/2010 | Fanner et al. | |
| 2010/0163261 | A1 | 7/2010 | Tomayko et al. | |
| 2010/0236801 | A1 | 9/2010 | Furusawa et al. | |
| 2010/0236804 | A1 | 9/2010 | Kriedel et al. | |
| 2010/0270046 | A1 | 10/2010 | Schlesak et al. | |
| 2010/0276168 | A1 | 11/2010 | Murthy et al. | |
| 2010/0307882 | A1 | 12/2010 | Ullrich et al. | |
| 2010/0326685 | A1 | 12/2010 | Roehm | |
| 2011/0005791 | A1 | 1/2011 | Baumann et al. | |
| 2011/0017483 | A1 | 1/2011 | Baumann et al. | |
| 2011/0167969 | A1 | 7/2011 | Erickson | |
| 2011/0174121 | A1 | 7/2011 | Erickson | |
| 2011/0179915 | A1 | 7/2011 | Peng | |
| 2011/0197719 | A1 | 8/2011 | Neitzell et al. | |
| 2011/0209888 | A1 | 9/2011 | Elsworthy | |
| 2011/0215538 | A1 | 9/2011 | Cornell et al. | |
| 2011/0226500 | A1 | 9/2011 | Furusawa et al. | |
| 2011/0227299 | A1 | 9/2011 | Yu | |
| 2011/0233878 | A1 | 9/2011 | Wan et al. | |
| 2011/0253458 | A1 | 10/2011 | Robey et al. | |
| 2011/0260415 | A1 | 10/2011 | Lin | |
| 2012/0000684 | A1 | 1/2012 | Sugimoto | |
| 2012/0051832 | A1 | 3/2012 | Krause et al. | |
| 2012/0061116 | A1 | 3/2012 | Aoki | |
| 2012/0074657 | A1 | 3/2012 | Zhou | |
| 2012/0074658 | A1 | 3/2012 | Puzio et al. | |
| 2012/0086177 | A1 | 4/2012 | Zhou et al. | |
| 2012/0087756 | A1 | 4/2012 | Kanematsu | |
| 2012/0098214 | A1 | 4/2012 | Ronald et al. | |
| 2012/0118596 | A1 | 5/2012 | Scott | |
| 2012/0139196 | A1 | 6/2012 | Zhou | |
| 2012/0186842 | A1* | 7/2012 | Wiedemann | B25D 11/125 173/48 |
| 2012/0186883 | A1 | 7/2012 | Purcell | |
| 2012/0193879 | A1 | 8/2012 | Furusawa et al. | |
| 2012/0326401 | A1 | 12/2012 | Puzio et al. | |
| 2013/0001897 | A1 | 1/2013 | Chen | |
| 2013/0026719 | A1 | 1/2013 | Johnsen | |
| 2013/0093142 | A1 | 4/2013 | Saur et al. | |
| 2013/0154202 | A1 | 6/2013 | Low et al. | |

* cited by examiner

ROTARY HAMMER

CROSS-REFERENCE TO RELATED APPLICATIONS

This application claims priority to U.S. Provisional Patent Application No. 61/691,920 filed on Aug. 22, 2012, the entire content of which is incorporated herein by reference.

FIELD OF THE INVENTION

The present invention relates to power tools, and more particularly to rotary hammers.

BACKGROUND OF THE INVENTION

Rotary hammers typically include a rotatable spindle, a reciprocating piston within the spindle, and a striker that is selectively reciprocable within the piston in response to an air pocket developed between the piston and the striker. Rotary hammers also typically include an anvil that is impacted by the striker when the striker reciprocates within the piston. The impact between the striker and the anvil is transferred to a tool bit, causing it to reciprocate for performing work on a work piece.

SUMMARY OF THE INVENTION

The invention provides, in one aspect, a rotary hammer adapted to impart axial impacts to a tool bit. The rotary hammer includes a motor, a spindle coupled to the motor for receiving torque from the motor, and a piston at least partially received within the spindle for reciprocation therein. A crank hub is coupled to the motor for receiving torque from the motor. The crank hub defines a rotational axis and includes a socket offset from the rotational axis. A pin includes a first portion at least partially received within the socket and a second portion fixed to the piston. The first portion of the pin is both pivotable within the socket and axially displaceable relative to the socket in response to rotation of the crank hub for reciprocating the piston between a forward-most position within the spindle and a rearward-most position within the spindle.

The invention provides, in another aspect, a rotary hammer adapted to impart axial impacts to a tool bit. The rotary hammer includes a motor defining a motor axis, a spindle coupled to the motor for receiving torque from the motor and an impact mechanism at least partially received within the spindle for imparting the axial impacts to the tool bit. The rotary hammer also includes a reciprocation mechanism for converting torque received from the motor to a reciprocating force acting on the impact mechanism. At least a portion of the reciprocation mechanism defines a rotational axis coaxial with the motor axis. The rotary hammer further includes a mode selection mechanism for activating and deactivating the impact mechanism and reciprocation mechanism. The mode selection mechanism is coaxial with the rotational axis and the motor axis.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
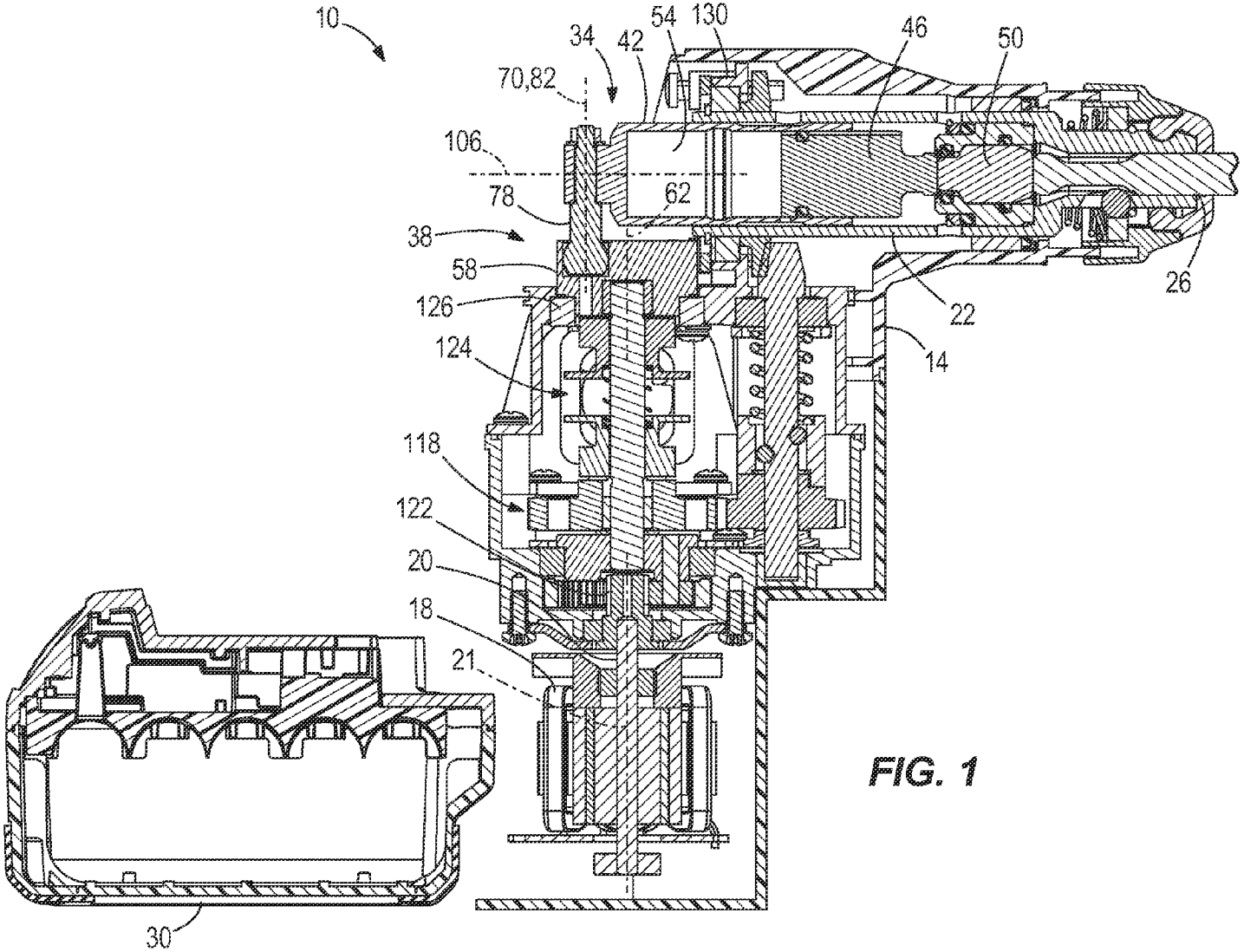
FIG. 1 is a cross-sectional view of a rotary hammer of the invention.

FIG. 1 illustrates a rotary hammer 10 including a housing 14 and a motor 18 disposed within the housing 14. The motor 18 includes an output shaft 20 defining a motor axis 21. The rotary hammer 10 further includes a rotatable spindle 22 coupled to the output shaft 20 of the motor 18 for receiving torque from the motor 18. A tool bit 26 may be secured to the spindle 22 for co-rotation with the spindle 22 (e.g., using a spline fit).

In the illustrated construction of the rotary hammer 10, the motor 18 is configured as a DC motor 18 that receives power from an on-board power source (e.g., a battery 30). The battery 30 may include any of a number of different nominal voltages (e.g., 12V, 18V, etc.), and may be configured having any of a number of different chemistries (e.g., lithium-ion, nickel-cadmium, etc.). Alternatively, the motor 18 may be powered by a remote power source (e.g., a household electrical outlet) through a power cord. The motor 18 is selectively activated by depressing a trigger (not shown) which, in turn, actuates a switch (also not shown). The switch may be electrically connected to the motor 18 via a top-level or master controller, or one or more circuits, for controlling operation of the motor 18.

With continued reference to FIG. 1, the rotary hammer 10 also includes an impact mechanism 34 for delivering repeated impacts to the tool bit 26, and a reciprocation mechanism 38 for converting torque received from the motor 18 to a reciprocating force acting on the impact mechanism 34. The impact mechanism 34 includes a reciprocating piston 42 disposed within the spindle 22 movable between a forward-most position within the spindle 22 and a rearward-most position within the spindle 22. The impact mechanism 34 also includes a striker 46 that is selectively reciprocable within the spindle 22 in response to reciprocation of the piston 42, and an anvil 50 that is impacted by the striker 46 when the striker 46 reciprocates toward the tool bit 26. The impact between the striker 46 and the anvil 50 is transferred to the tool bit 26, causing it to reciprocate for performing work on a work piece. In the illustrated construction of the rotary hammer 10, the piston 42 is hollow and defines an interior chamber 54 in which the striker 46 is received. An air pocket is developed between the piston 42 and the striker 46 when the piston 42 reciprocates within the spindle 22, whereby expansion and contraction of the air pocket induces reciprocation of the striker 46.

Figure 2:
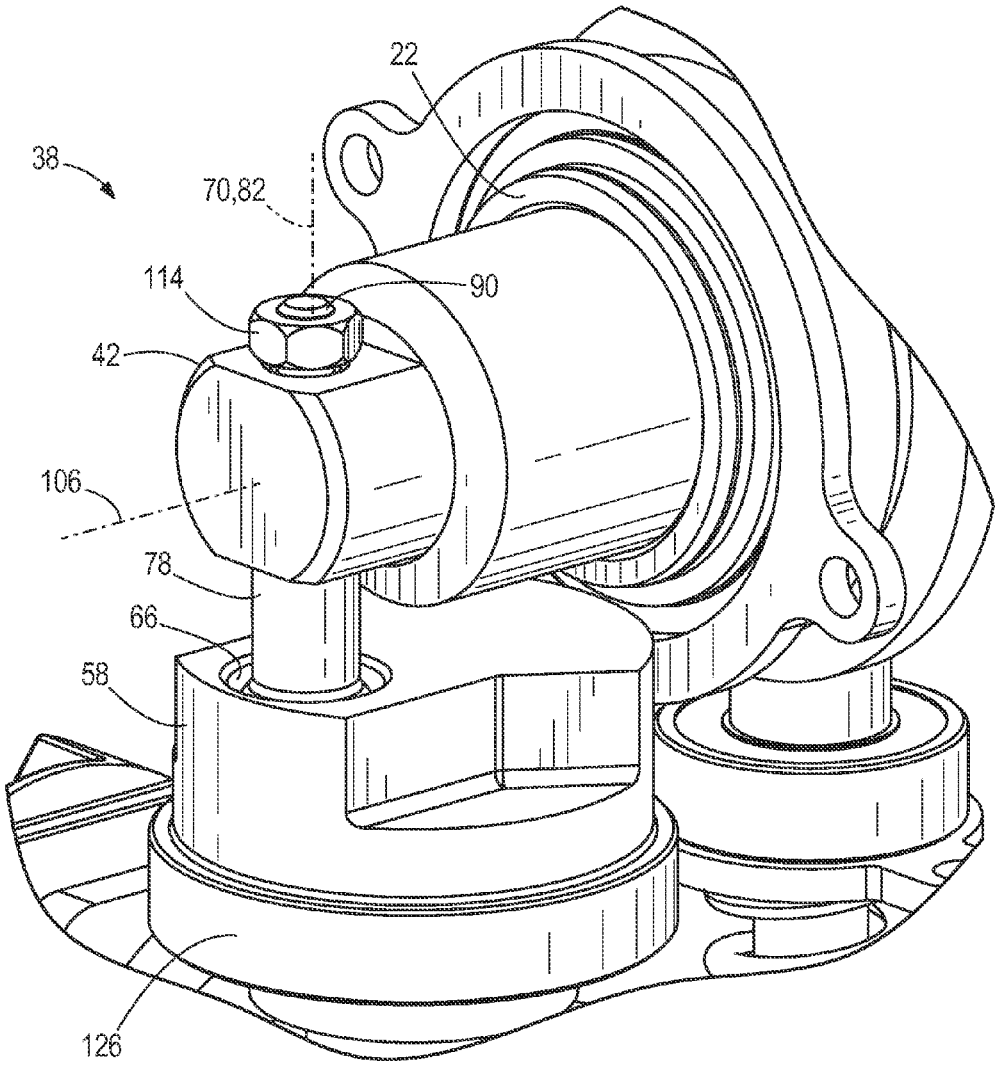
FIG. 2 is an enlarged perspective view of a reciprocation mechanism of the rotary hammer of FIG. 1.

With reference to FIGS. 1 and 2, the reciprocation mechanism 38 includes a crank hub 58 that is rotatable about a rotational axis 62. In the illustrated construction, the rotational axis 62 of the crank hub 58 is coaxial with the motor axis 21, allowing for a relatively compact arrangement of the motor 14, the impact mechanism 34, and the reciprocation mechanism 38 within the housing 14. Alternatively, the rotational axis 62 of the crank hub 58 may by offset from the motor axis 21.

The crank hub 58 includes a cylindrical socket 66, defining a central axis 70 (FIGS. 3 and 4) offset from the rotational axis 62 of the crank hub 58, formed in a top surface 74 of the crank hub 58. The reciprocation mechanism 38 also includes a pin 78 defining a longitudinal axis 82 and coupling the crank hub 58 to the piston 42. The pin 78 has a spherical end 86 received within the socket 66. The diameter of the socket 66 is nominally larger than the diameter of the spherical end 86 of the pin 78 such that the pin 78 may move freely within the socket 66, but without excessive clearance. As is described in further detail below, the spherical end 86 of the pin 78 is both pivotable within the socket 66 and axially displaceable relative to the socket 66 in response to rotation of the crank hub 58. The pin 78 also includes a threaded end 90 distal to the crank hub 58, and a cylindrical shank 94 having a shoulder 98 with a larger diameter than the threaded end 90. The pin 78 is preferably formed as a single piece; however, alternative shapes and constructions of the pin 78 are possible.

Figure 4:
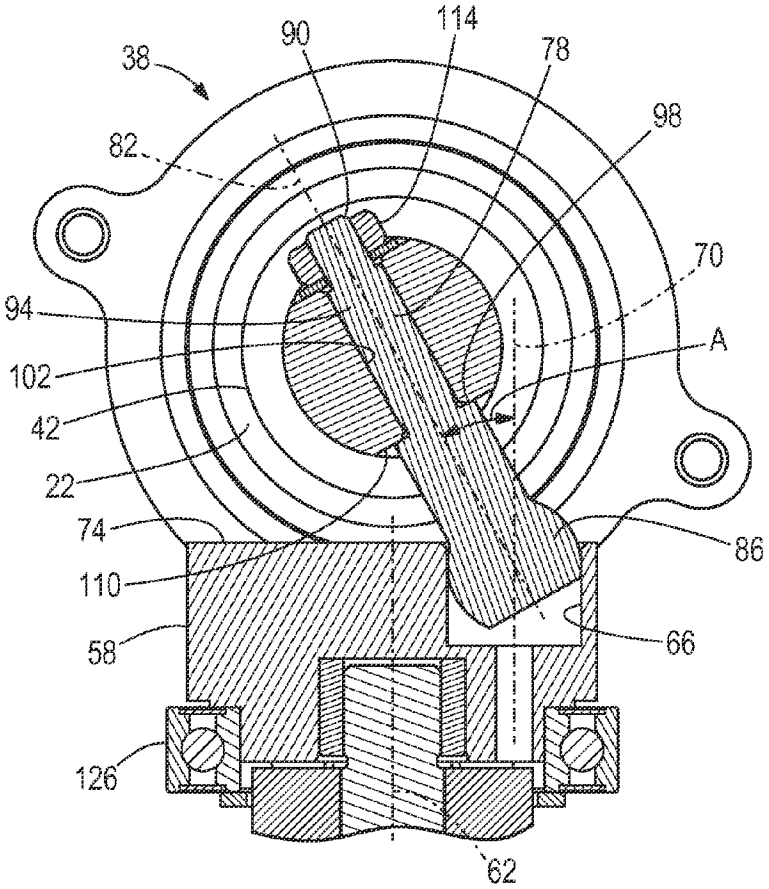
FIG. 4 is another cross-sectional view of the reciprocation mechanism of FIG. 2, illustrating the reciprocation mechanism rotated approximately 90 degrees from the orientation shown in FIG. 3.
Figure 3:
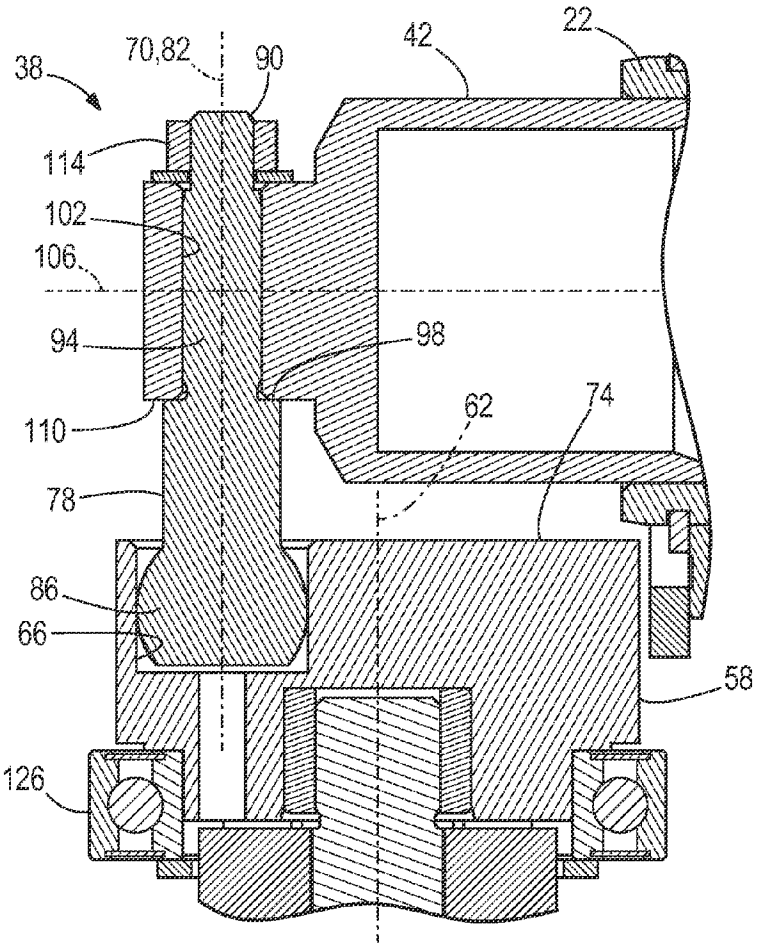
FIG. 3 is a cross-sectional view of the reciprocation mechanism of FIG. 2.

With continued reference to FIGS. 3 and 4, the piston 42 includes an aperture 102 extending in a direction transverse to a reciprocating axis 106 of the piston 42. The shank 94 is received in the aperture 102 to an extent limited by the shoulder 98 engaging a peripheral surface 110 of the piston 42 surrounding the aperture 102. The shank 94 is fixed within the aperture 102 using an interference or press-fit, which provides a secure engagement between the pin 78 and the piston 42. In the illustrated construction of the reciprocation mechanism 38, the threaded end 90 of the pin 78 receives a conventional fastener 114 (e.g., a nut) to clamp the piston 42 between the fastener 114 and the shoulder 98 of the pin 78. The fastener 114 provides an additional means of securing the pin 78 to the piston 42 should the interference fit become loosened (e.g., due to thermal expansion). Alternatively, the fastener 114, and therefore the threaded end 90 of the pin 78, may be omitted.

Figure 5:
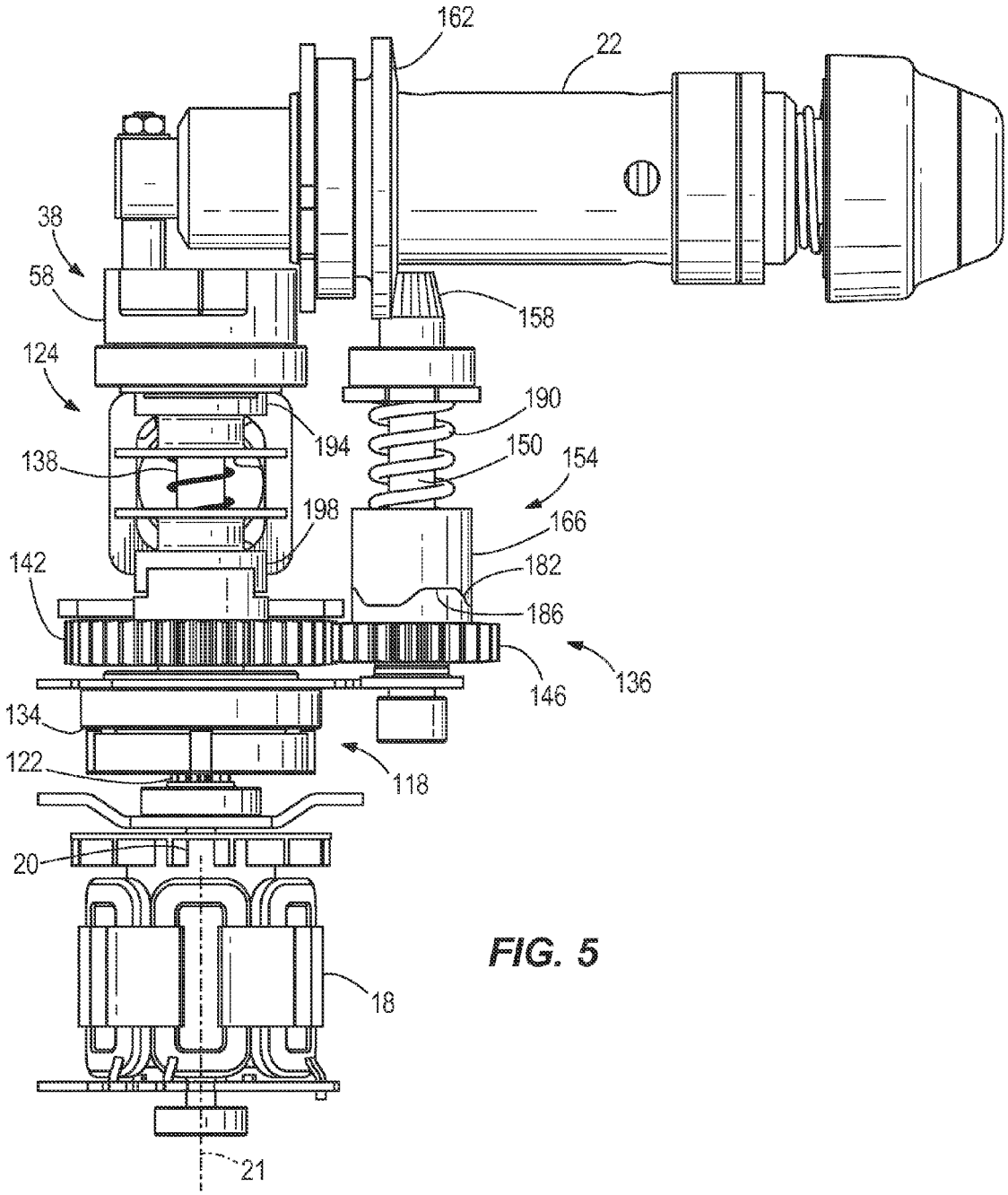
FIG. 5 is a plan view of a drivetrain of the rotary hammer of FIG. 1

FIG. 5 illustrates a drivetrain 136 of the rotary hammer 10, including a planetary transmission 118 driven by a pinion 122 on the output shaft 20 of the motor 18. The planetary transmission 118 includes a carrier 134 and an output shaft 138 coupled for co-rotation with the carrier 134. Torque from the output shaft 138 is transferred to the reciprocation mechanism 38 to rotate the reciprocation mechanism 38. The rotary hammer 10 further includes a drive gear 142 that selectively receives torque from the output shaft 138, and a driven gear 146 meshed with the drive gear 142 for rotating an offset intermediate shaft 150 via a clutch mechanism 154, described in greater detail below. The intermediate shaft 150 includes a pinion 158 at a top end thereof continuously meshed with a bevel gear 162 fixed for co-rotation with the spindle 22. As such, rotation of the intermediate shaft 150 causes rotation of the spindle 22. In the illustrated embodiment, the output shaft 138 and the drive gear 142 are coaxial with the motor axis 21; however, in other embodiments, the output shaft 138 and the drive gear 142 may be offset from the motor axis 21 or oriented perpendicular to the motor axis 21.

Figure 6:
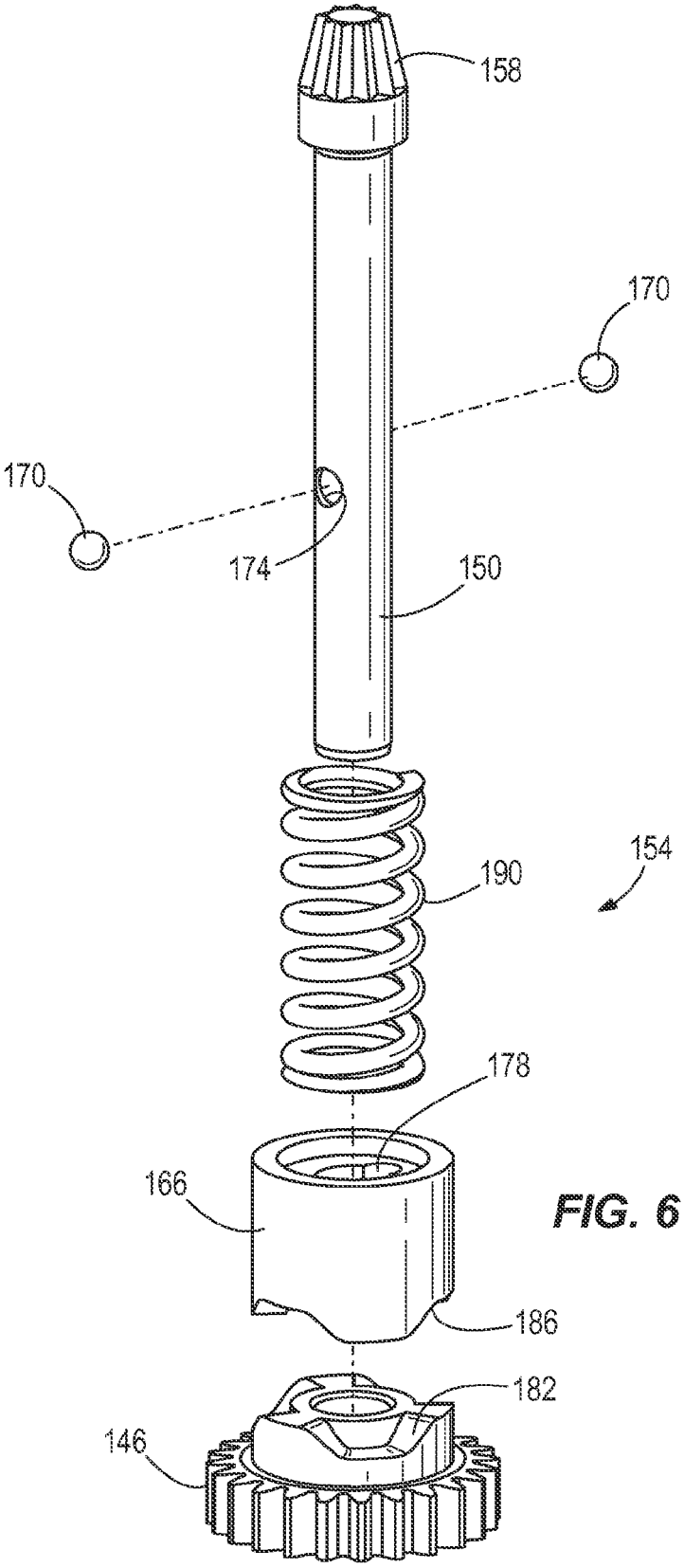
FIG. 6 is an exploded view of a clutch mechanism of the rotary hammer of FIG. 1.

With reference to FIG. 6, the clutch mechanism 154 includes a clutch member 166 axially keyed to the intermediate shaft 150 via spherical rollers 170 received in respective holes 174 in the intermediate shaft 150 and corresponding keyways 178 in the clutch member 166 (see also FIG. 1). As such, the clutch member 166 is slidable along the intermediate shaft 150, yet fixed for co-rotation with the intermediate shaft 150.

The driven gear 146 and the clutch member 166 include respective cam surfaces 182, 186 that are biased into engagement by a compression spring 190. When the reaction torque on the spindle 22 (FIG. 5) during a drilling or fastening operation is below a predetermined threshold, torque is transferred from the motor 18 to the spindle 22 via the drive gear 142, the driven gear 146, the respective cam surfaces 182, 186, the spherical rollers 170 (FIG. 6), and the intermediate shaft 150. Particularly, the force exerted by the spring 190 is sufficient to maintain the respective cam surfaces 182, 186 wedged against each other to permit torque transfer from the driven gear 146 to the clutch member 166. When reaction torque on the spindle 22 exceeds the predetermined threshold, the force of the spring 190 is insufficient to maintain the cam surfaces 182, 186 wedged against each other. In this instance, the cam surface 182 on the driven gear 146 slips relative to the cam surface 186 on the clutch member 166, causing the clutch member 166 to axially reciprocate on the intermediate shaft 150 against the bias of the spring 190 in response to continued rotation of the motor 18, drive gear 142, and the driven gear 146. As such, torque is no longer transferred to the clutch member 166 and the intermediate shaft 150 to rotate the spindle 22.

With reference to FIG. 1, the rotary hammer 10 further includes a mode selection mechanism 124 positioned downstream of the planetary transmission 118 for switching the rotary hammer 10 between a "drill" mode, in which the impact and reciprocation mechanisms 34, 38 are deactivated, a "hammer-drill" mode, in which the impact and reciprocation mechanisms 34, 38 are both activated, and a "hammer-only" mode, in which torque from the motor 18 is not transferred to the spindle 22 to rotate the spindle 22. In the illustrated embodiment, the hammer-only mode includes a "freewheel" or neutral sub-mode in which the spindle 22 is free to rotate and a "spindle-lock" sub-mode in which the spindle 22 is prevented from rotating.

Figure 7:
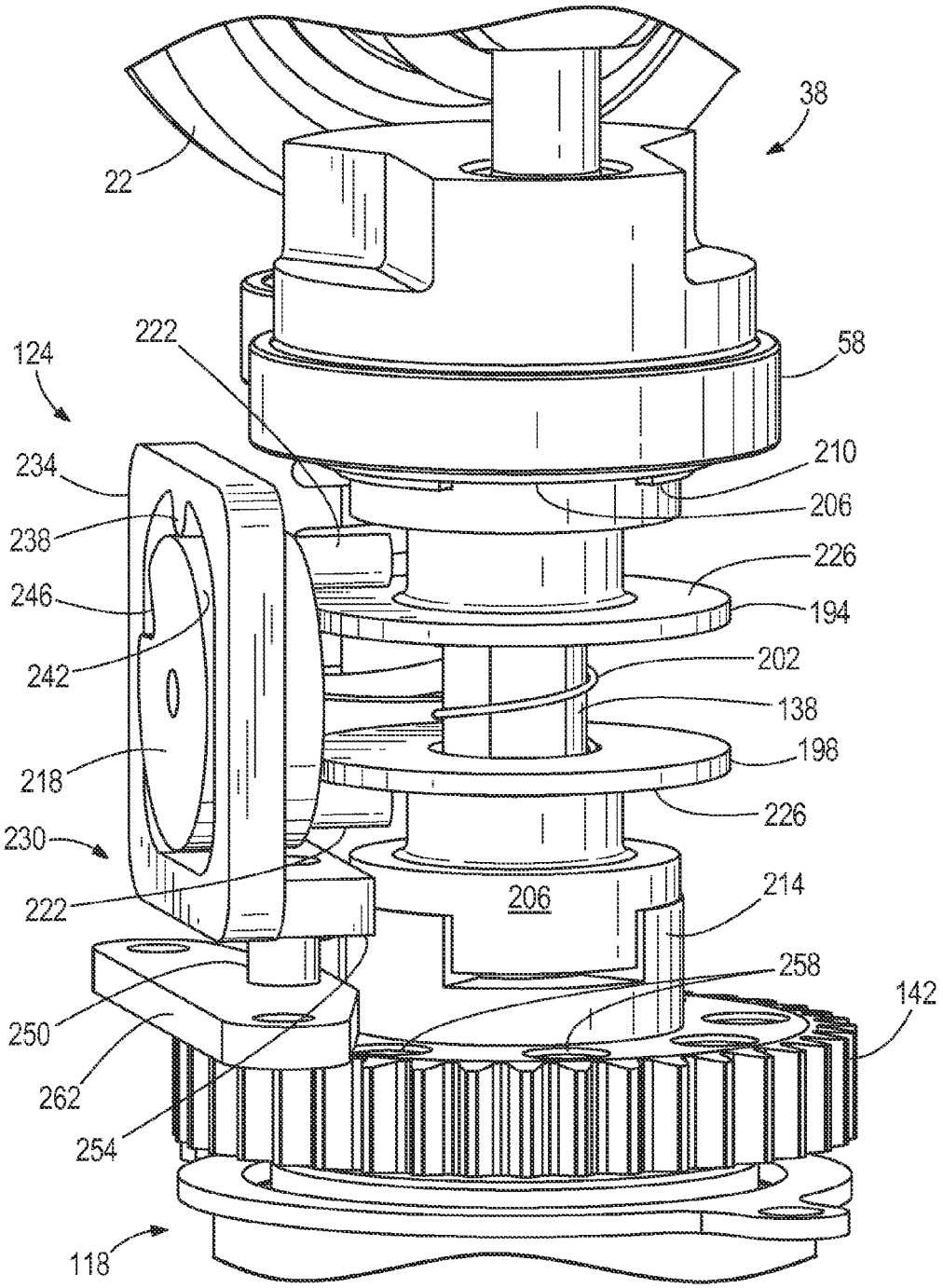
FIG. 7 is a perspective view of a mode selection mechanism of the rotary hammer of FIG. 1.

Referring to FIG. 7, the mode selection mechanism 124 includes a pair of identical, opposed couplers 194, 198 each of which is keyed to the output shaft 138 for co-rotation therewith. As such, the couplers 194, 198 are each coaxial with the motor axis 21 (FIG. 1) of the rotary hammer 10. A compression spring 202 is located between the couplers 194, 198 to bias the couplers 194, 198 apart and toward the respective drive gear 142 and the crank hub 58. Each of the couplers 194, 198 includes teeth 206 that selectively engage corresponding teeth 210, 214 on the crank hub 58 and the drive gear 142, respectively. The mode selection mechanism 124 also includes an actuator 218 having two pins 222 that are received within corresponding annular grooves 226 in the respective couplers 194, 198. As such, the pins 222 are permitted to ride within the grooves 226 as the couplers 194, 198 rotate with the output shaft 138. A shift knob (not shown) is coupled to the actuator 218 and is accessible by the user of the rotary hammer 10 to toggle the actuator 218 to individually slide the couplers 194, 198 along the output shaft 138 for shifting the rotary hammer 10 between the modes mentioned above.

The mode selection mechanism 124 further includes a locking mechanism 230 movable between an unlocked position and a locked position for preventing rotation of the spindle 22 when the rotary hammer 10 is placed in the spindle-lock sub-mode. The locking mechanism includes a yoke 234 that surrounds the actuator 218 and has an inner projection 238 that engages an outer cam surface 242 of the actuator 218. When the actuator 218 is rotated to a predetermined position (corresponding with the spindle-lock sub-mode), the inner projection 238 aligns with an indentation 246 in the outer cam surface 242, allowing the yoke 234 to move downward relative to the actuator 218 under the biasing force of a spring (not shown). A post 250, extending from a bottom portion 254 of the yoke 234, is received in one of a plurality of axial bores 258 extending through the drive gear 142, thereby preventing rotation of the drive gear 142, driven gear 146, intermediate shaft 150, and ultimately, the spindle 22 (assuming any torque applied to the spindle 22 is insufficient to cause slippage of the clutch member 166, as described above). In the illustrated embodiment, the post 250 extends through a plate 262 fixed to the housing 14 of the rotary hammer 10 to provide lateral support to the post 250. When the actuator 218 is rotated away from the predetermined position, projection 238 rides up the outer cam surface 242 to move the yoke 234 upward against the biasing force of the spring to remove the post 250 from one of the bores 258 in the drive gear 142.

Figure 8:
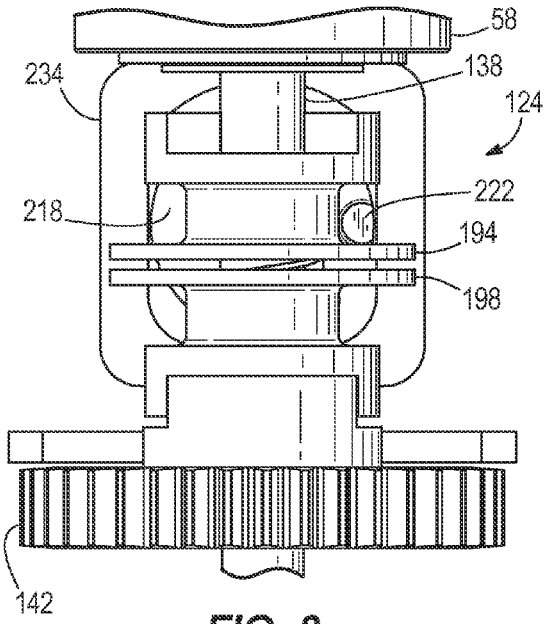
FIG. 8 is a plan view of the mode selection mechanism of FIG. 7 in a drill-only mode.
Figure 9:
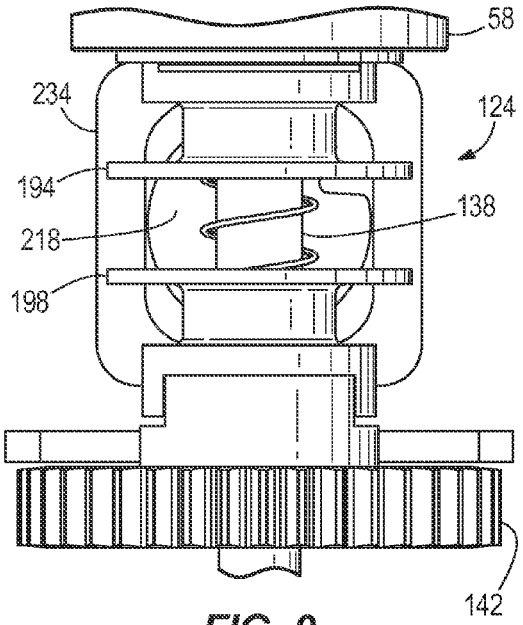
FIG. 9 is a plan view of the mode selection mechanism of FIG. 7 in a hammer-drill mode.
Figure 10:
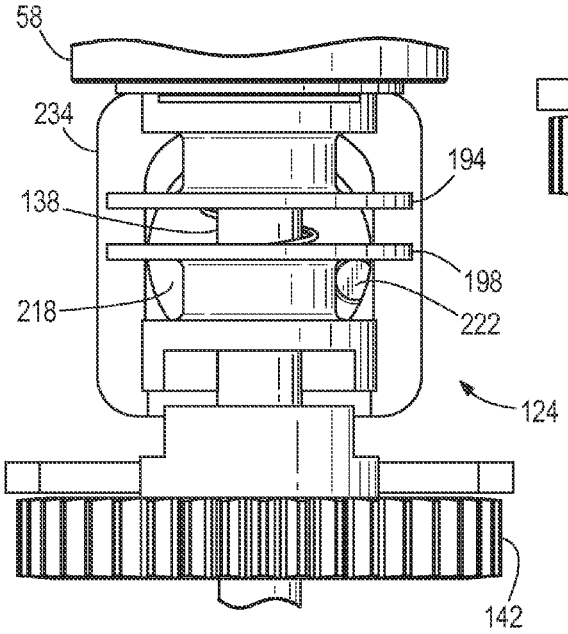
FIG. 10 is a plan view of the mode selection mechanism of FIG. 7 in a hammer-only mode, and more particularly in a freewheel sub-mode.
Figure 11:
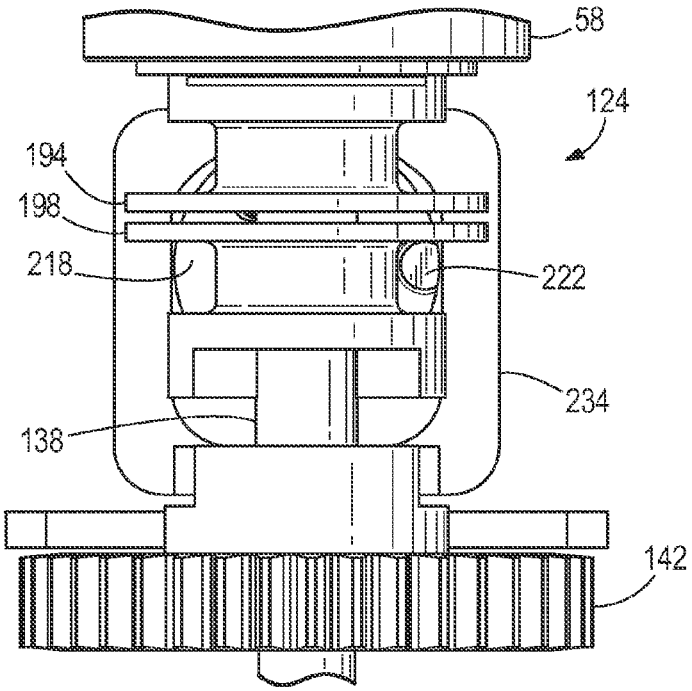
FIG. 11 is a plan view of the mode selection mechanism of FIG. 7 in a hammer-only mode, and more particularly in a spindle-lock sub-mode.
Figure 12:
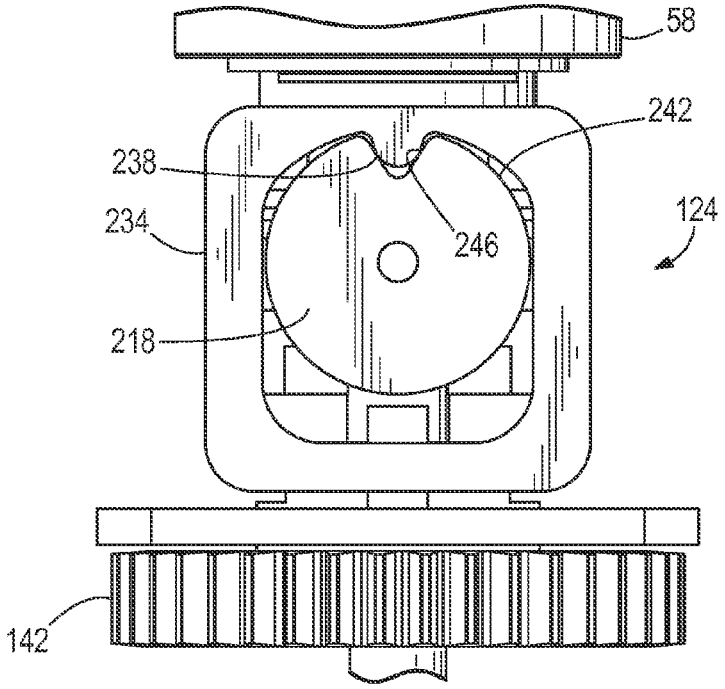
FIG. 12 is another plan view of the mode selection mechanism of FIG. 11.

FIG. 8 illustrates the actuator 218 in a first rotational position in which the coupler 194 is disengaged from the crank hub 58 and the coupler 198 is engaged with the drive gear 142 for operating the rotary hammer 10 in drill-only mode. FIG. 9 illustrates the actuator 218 in a second rotational position in which the couplers 194, 198 are engaged with the crank hub 58 and the drive gear 142, respectively, for operating the rotary hammer 10 in hammer-drill mode. FIG. 10 illustrates the actuator 218 in a third rotational position in which the coupler 194 is engaged with the crank hub 58 and the coupler 198 is disengaged from the drive gear 142 for operating the rotary hammer 10 in the hammer-only mode. The locking mechanism 230 is in the unlocked position for operating the rotary hammer 10 in the neutral sub-mode, permitting free rotation of the spindle 22. FIGS. 11 and 12 illustrate the actuator 218 in a fourth rotational position in which the inner projection 238 of the yoke 234 is aligned with the indentation 246 in the outer cam surface 242 (FIG. 12). Accordingly, the locking mechanism 230 is in the locked position for operating the rotary hammer 10 in the spindle-lock sub-mode.

During steady-state operation of the rotary hammer 10 in either the hammer-drill mode or the hammer-only mode, torque is transmitted from the motor 18 to the crank hub 58 via the planetary transmission 118 and the mode selection mechanism 124, causing the crank hub 58 to continuously rotate through successive 360-degree cycles. Each 360-degree cycle can be divided into four discrete 90-degree quadrants, with the pin 78 both pivoting and being axially displaced within the socket 66 while the crank hub 58 is rotating within any of the 90-degree quadrants.

A first rotational position of the crank hub 58 corresponds to the forward-most position of the piston 42 within the spindle 22. In the first rotational position, the longitudinal axis 82 of the pin 78 is collinear or coaxial with the central axis 70 of the socket 66. As the crank hub 58 rotates from the first rotational position towards a second rotational position, offset 90 degrees from the first rotational position, the piston 42 moves from the forward-most position toward an intermediate position within the spindle 22 (FIG. 4). The pin 78 pivots within the socket 66 to form an oblique included angle A between the central axis 70 of the socket 66 and the longitudinal axis 82 of the pin 78. In the illustrated construction of the reciprocation mechanism 38, the angle A has a maximum value at the second rotational position of the crank hub 58, preferably about 29 degrees or less. As the crank hub 58 rotates from the second rotational position towards a third rotational position, offset 180 degrees from the first rotational position, the piston 42 moves from the intermediate position to the rearward-most position within the spindle 22, reducing the angle A until the longitudinal axis 82 of the pin 78 is again collinear or coaxial with the central axis 70 of the socket 66 (FIG. 3). As the crank hub 58 rotates from the third rotational position towards a fourth rotational position, offset 270 degrees from the first rotational position, the piston 42 reverses direction and moves from the rearward-most position towards the forward-most position. The angle A again increases to its maximum value at the fourth rotational position, coinciding with another intermediate position of the piston 42 within the spindle 22 (FIG. 4). The crank hub 58 rotates from the fourth rotational position back to the first rotational position, thereby completing one full rotation of the crank hub 58 and one reciprocation cycle of the piston 42.

In operation of the rotary hammer 10, the spherical end 86 of the pin 78 both pivots and is axially displaced within the socket 66 in response to rotation of the crank hub 58 from the first position to the second position, from the second position to the third position, from the third position to the fourth position, and from the fourth position back to the first position. For example, during rotation of the crank hub 58 from the third position (FIG. 3) to the fourth position (FIG. 4), the spherical end 86 of the pin 78 is both pivoted within the socket 66 toward the maximum value of angle A and displaced upwardly within the socket 66. However, the spherical end 86 cannot be removed from the socket 66 because the crank hub 58 and the spindle 22, in which the piston 42 is supported, are supported within the housing 14 by respective bearings 126, 130 (FIG. 1). As such, the spherical end 86 of the pin 78 is constrained within the socket 66 by way of the positions of the crank hub 58 and the spindle 22 being constrained, respectively, by the bearings 126, 130. Accordingly, separate retainers or biasing elements for positively maintaining the spherical end 86 within the socket 66 are unnecessary.

Various features of the invention are set forth in the following claims.

What is claimed is:

1. A rotary hammer adapted to impart axial impacts to a tool bit, the rotary hammer comprising:

a motor including an output shaft that defines a motor axis;

a spindle coupled to the motor for receiving torque from the motor;

a piston at least partially received within the spindle for reciprocation therein;

a crank hub coupled to the motor for receiving torque from the motor, the crank hub defining a rotational axis coaxial with the motor axis and including a socket offset from the rotational axis;

a pin including a first portion at least partially received within the socket and a second portion fixed to the piston to inhibit relative movement between the pin and the piston, the first portion of the pin being both pivotable within the socket and axially displaceable relative to the socket in response to rotation of the crank hub for reciprocating the piston between a forward-most position within the spindle and a rearward-most position within the spindle; and a mode selection mechanism including a first coupler movable along the rotational axis to selectively connect and disconnect the spindle and the motor, and a second coupler movable along the rotational axis to selectively connect and disconnect the crank hub and the motor.

2. The rotary hammer of claim 1, wherein the first portion includes a generally spherical end.

3. The rotary hammer of claim 2, wherein the spherical end includes a first diameter, and wherein the socket includes a second diameter nominally larger than the first diameter of the spherical end.

4. The rotary hammer of claim 1, wherein the piston includes an aperture in which the pin is received, and wherein the pin is fixed relative to the piston using an interference fit with the aperture.

5. The rotary hammer of claim 4, wherein the pin includes a shoulder limiting an extent to which the pin is received within the aperture, and wherein the shoulder is engaged with a peripheral surface of the piston surrounding the aperture.

6. The rotary hammer of claim 5, wherein the second portion of the pin is threaded, and wherein the rotary hammer further includes a fastener threaded to the second portion of the pin.

7. The rotary hammer of claim 6, wherein the piston is clamped between the shoulder and the fastener.

8. The rotary hammer of claim 1, wherein one revolution of the crank hub can be divided into at least a first rotational position, a second rotational position offset 90 degrees from the first rotational position, a third rotational position offset 180 degrees from the first rotational position, and a fourth rotational position offset 270 degrees from the first rotational position.

9. The rotary hammer of claim 8, wherein the forward-most position of the piston coincides with the first rotational position, and the rearward-most position coincides with the third rotational position.

10. The rotary hammer of claim 8, wherein the socket defines a central axis parallel with the rotational axis of the crank hub, and wherein the pin defines a longitudinal axis that is substantially coaxial with the central axis in the first and third rotational positions of the crank hub.

11. The rotary hammer of claim 10, wherein the pin is pivoted relative to the crank hub in the second and fourth rotational positions of the crank hub to define an oblique included angle between the central and longitudinal axes of the socket and the pin, respectively.

12. The rotary hammer of claim 11, wherein the oblique included angle is about 29 degrees or less.

13. The rotary hammer of claim 11, wherein the oblique included angle has a minimum value coinciding with the first and third rotational positions of the crank hub, and wherein the oblique included angle has a maximum value coinciding with the second and fourth rotational positions of the crank hub.

14. The rotary hammer of claim 1, further comprising a striker received within the spindle for reciprocation in response to reciprocation of the piston.

15. The rotary hammer of claim 14, further comprising an anvil received within the spindle and positioned between the striker and the tool bit, the anvil imparting axial impacts to the tool bit in response to reciprocation of the striker.

16. The rotary hammer of claim 14, wherein the piston is hollow and defines an interior chamber in which the striker is received.

17. The rotary hammer of claim 1, wherein the piston defines a reciprocating axis, and wherein the piston rotates about the reciprocating axis as the pin pivots within the socket.

18. The rotary hammer of claim 1, wherein the mode selection mechanism is configured to switch the rotary hammer between a drill mode, in which torque from the motor is not transferred to the crank hub, a hammer-drill mode, in which both the crank hub and the spindle receive torque from the motor, and a hammer-only mode, in which torque from the motor is not transferred to the spindle.

19. A rotary hammer adapted to impart axial impacts to a tool bit, the rotary hammer comprising:

a motor defining a motor axis;

a spindle coupled to the motor for receiving torque from the motor;

an impact mechanism at least partially received within the spindle for imparting the axial impacts to the tool bit;

a reciprocation mechanism for converting torque received from the motor to a reciprocating force acting on the impact mechanism, at least a portion of the reciprocation mechanism defining a rotational axis coaxial with the motor axis; and a mode selection mechanism including a first coupler movable along the rotational axis to selectively connect and disconnect the spindle and the motor, and a second coupler movable along the rotational axis to selectively connect and disconnect the reciprocation mechanism and the motor.

* * * * *